US008570230B2

(12) United States Patent
Matsunaga et al.

(10) Patent No.: US 8,570,230 B2
(45) Date of Patent: Oct. 29, 2013

(54) ANTENNA

(75) Inventors: Mayumi Matsunaga, Ehime (JP); Yasuhiro Yokota, Ehime (JP)

(73) Assignee: National University Corporation Ehime University, Ehime (JP)

( * ) Notice: Subject to any disclaimer, the term of this patent is extended or adjusted under 35 U.S.C. 154(b) by 1004 days.

(21) Appl. No.: 12/602,126

(22) PCT Filed: Feb. 29, 2008

(86) PCT No.: PCT/JP2008/000401

§ 371 (c)(1),
(2), (4) Date: Nov. 27, 2009

(87) PCT Pub. No.: WO2008/146430

PCT Pub. Date: Dec. 4, 2008

(65) Prior Publication Data

US 2010/0164820 A1 Jul. 1, 2010

(30) Foreign Application Priority Data

May 31, 2007 (JP) ..... 2007-144379
Nov. 27, 2007 (JP) ..... 2007-306655

(51) Int. Cl.
*H01Q 1/00* (2006.01)

(52) U.S. Cl.
USPC ..... 343/729; 343/733; 343/749

(58) Field of Classification Search
USPC ..... 343/729
See application file for complete search history.

(56) References Cited

U.S. PATENT DOCUMENTS

| | | | | |
|---|---|---|---|---|
| 4,804,965 | A * | 2/1989 | Roederer | 343/700 MS |
| 5,289,198 | A * | 2/1994 | Altshuler | 343/729 |
| 5,909,050 | A * | 6/1999 | Furey et al. | 257/531 |
| 6,995,732 | B2 * | 2/2006 | Goebel et al. | 343/908 |
| 7,334,734 | B2 * | 2/2008 | Hino et al. | 235/492 |
| 7,339,546 | B2 | 3/2008 | Pangaud et al. | |

FOREIGN PATENT DOCUMENTS

| | | |
|---|---|---|
| JP | 2001-175960 | 6/2001 |
| JP | 2002-109497 | 4/2002 |
| JP | 2004-312431 | 11/2004 |
| JP | 2006-522517 | 9/2006 |

OTHER PUBLICATIONS

Matsunaga, Matsuoka, Matsunaga, Yokota, "A Suggested Shape of Spirals for Expanding the Half-Power Beamwidths of UHF Band RFID's Planar Spiral Antennae", Oct. 2008, Proc. 2008 International Symposium on Antennas and Propagation, Taipei, pp. 1422-1425.*

(Continued)

*Primary Examiner* — Jerome Jackson, Jr.
*Assistant Examiner* — Hai Tran
(74) *Attorney, Agent, or Firm* — Wenderoth, Lind & Ponack, L.L.P.

(57) ABSTRACT

An antenna includes a simple structure and a small null angle, which achieves communication using a circularly-polarized wave. The antenna includes a conductive wire arranged in loops in such a way as to form a cross shape. A part at which two line portions projecting outward from the center portion define a right angle is included in the loop path of the conductive wire. This part allows the antenna to transmit and receive an electromagnetic wave in all directions and have a circular polarization characteristic.

2 Claims, 10 Drawing Sheets

(56) References Cited

OTHER PUBLICATIONS

M.R. Chaharmir, J. Shaker, M. Cuhaci and A. Ittipiboon, "*Broadband reflectarray antenna with double cross loops*", Electronics Letters, Jan. 19, 2006, vol. 42, No. 2.

International Search Report issued May 27, 2008 in International (PCT) Application No. PCT/JP2008/000401.

H.-K. Ryu and J.-M. Woo, "*Miniaturisation of circular loop antenna using short stub for RFID system*", Electronics Letters, Aug. 2006, vol. 42, No. 17, pp. 955-956.

M. Stupf, R. Mittra, J. Yeo and J.R. Mosig, "*Some novel design for RFID antennas and their performance enhancement with metamaterials*", IEEE Antennas and Propagation Society International Symposium 2006 digest, Jul. 2006, pp. 1023-1026.

* cited by examiner

ANTENNA

FIELD OF THE INVENTION

The present invention relates to an antenna for communications using electromagnetic waves, e.g., a communication antenna used for an IC tag, an IC reader writer, a ground digital television set, a global positioning system, and so forth.

BACKGROUND OF THE INVENTION

IC tags having an electronic circuit and transceiver mounted on a small substrate are becoming popular; for example, cards used as electronic money for a fare for a railroad, or the like have appeared. Further, applications in the field of animal husbandry are also expected as merchandise management, or measures against the mad cow disease and the avian influenza. A dipole antenna or a loop antenna is used in the spreading cards. These antennas have intense directivity, so that they have a high sensitivity in a specific direction while having a low sensitivity in the other directions.

Patent Document 1 describes that communications in all directions are enabled by selectively using two dipole antennas which are arranged orthogonal to each other.

Patent Documents 2 and 3 describe magnetic coil antennas which read a magnetic signal. Patent Documents 4 to 6 describe antennas for a noncontact IC card.

[Patent Document 1] JP-A-2006-39899
[Patent Document 2] JP-A-2002-109497
[Patent Document 3] JP-A-2000-114853
[Patent Document 4] JP-A-2001-84343
[Patent Document 5] JP-A-2006-168913
[Patent Document 6] JP-A-2001-175960

SUMMARY OF THE INVENTION

A loop antenna or the like provided in a card with an IC tag has an intense directivity. The range of the direction in which the sensitivity of an antenna drops is called a null angle, which was large for antennas in the past. Therefore, when the user of a card with an IC tag adequately directs the card toward a reader, the card can transmit and receive correctly, whereas when the card is directed in a direction corresponding to the null angle, accurate information exchange cannot be performed.

When a card with an IC tag is used for the purpose of the payment of a fare, for example, it can be expected to some extent that a user will set the card in the proper direction to the reader provided at a ticket gate. In case of attaching IC tags to the cases of commodities for merchandise management or attaching IC tags to cows or the like for animal husbandry management, however, the IC tags face in various directions. Therefore, antennas in the past for an IC tag which have a large null angle can be used only in limited conditions.

It is described that the noncontact IC tag according to Patent Document 1 can enable communication in all directions. However, the noncontact IC tag needs a changeover switch and two power supply circuits or a comparison device or the like, complicating the circuit. The circuits to be mounted in an IC tag should be compact. Further, it is desirable to mass-produce IC tags at a low cost.

In the noncontact IC tag described in Patent Document 1, it is one dipole antenna that is operating, so that an electric wave transmitted therefrom is a linearly polarized wave. Therefore, when the polarization direction does not match with the reader, it is difficult to perform communication. Circular polarization can be achieved by performing transmission while strictly controlling the mutual phases of the two dipole antennas, which however makes the transmission/reception circuit more complicated.

The inventions described in Patent Documents 2 and 3 relate to magnetic coil antennas which read a magnetic signal. Thus, although the term "antenna" is used, the antenna is quite irrelevant to an antenna which performs communication using an electromagentic wave.

The invention described in Patent Document 4 relates to an antenna for a noncontact IC, and is intended to improve the mechanical strength, and the directivity and polarization characteristic are not described at all. The antenna with the shape shown in Patent Document 4 cannot realize omnidirectivity.

The invention described in Patent Document 5 likewise relates to an antenna for a noncontact IC, and has multiple antennas connected by diodes and capacitors. The structure is complex, which eventually increases the cost. Although omnidirectivity and circular polarization are mentioned, detailed data is not provided, so that it is not clear what level of characteristics can be realized.

Further, the invention described in Patent Document 6 likewise relates to an antenna for a noncontact IC, and illustrates a shape formed by connecting square antennas connected to four corner portions of a central square antenna. While it is an object of the invention to secure a wide communication area on the antenna surface, data presented in the document does not bring about an effect more than the effect provided by combining the a plurality of loop-like elements. In addition, the polarization characteristic is not suggested at all.

To solve the foregoing problems, according to the invention, there is provided an antenna formed by arranging a conductive wire in loops, characterized by having an outer shape which has a quadrangular center portion and four projections projecting from four peripheral sides of the center portion, or characterized by having an outer shape which has two rectangles overlapping each other with centers of gravity thereof matching with each other and having directions shifted from each other.

Alternatively, there is provided an antenna including a conductive wire arranged in loops in such a way as to form a cross shape. The antenna according to claim 3, wherein there may be a plurality of spiral loops forming the cross shape. A power feeding point may be provided at the center portion. Further, it is preferable to loop the conductive wire densely around and up to the center portion.

The invention has the effect that the conductive wire arranged in loops in such a way as to form a cross shape can realize the antenna having a small null angle and communicatable in substantially all directions. There also is the effect that circular-polarization based communication is enabled without using a special transmission/reception circuit.

DESCRIPTION OF REFERENCE NUMERALS

1. antenna
2, 3 conductive wire
4. power feeding point

DETAILED DESCRIPTION OF THE INVENTION

Figure 1:
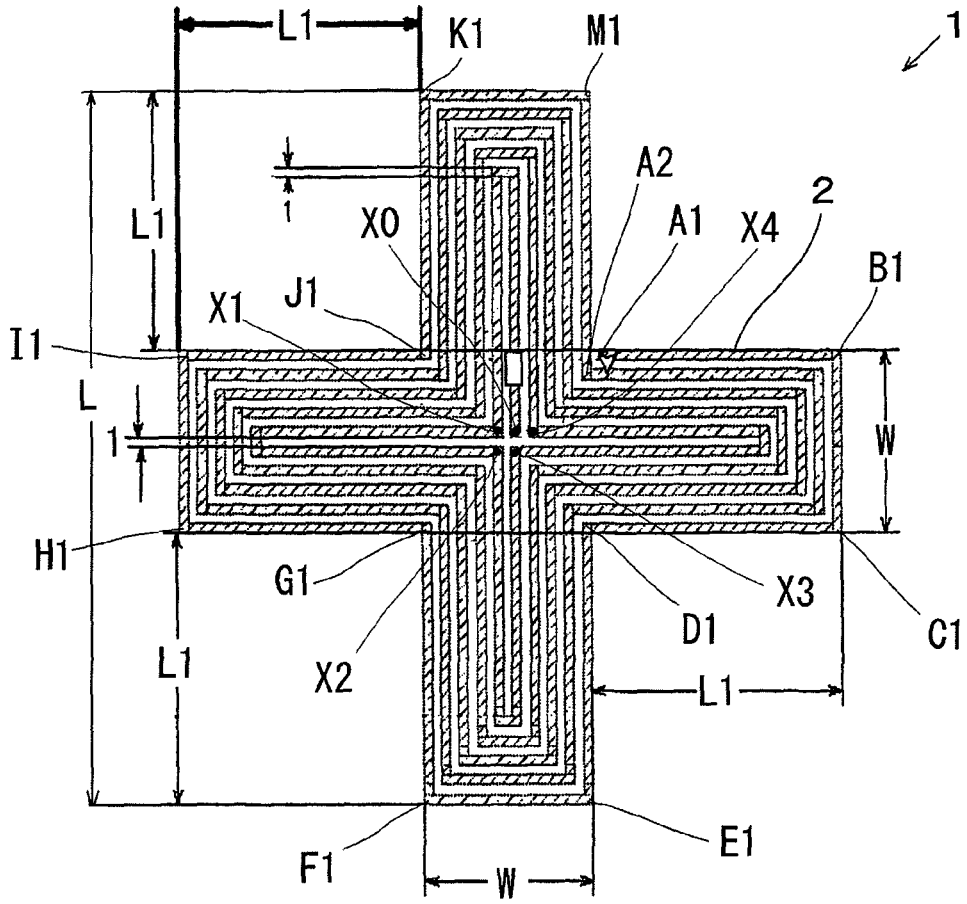
FIG. 1 is a plan view showing a first example of an antenna.

The best mode for carrying out the invention will be explained referring to the accompanying drawings. FIG. 1 is a plan view showing a first example of an antenna.

An antenna formed by arranging a conductive wire in loops has an outer shape which has a quadrangular center portion and four projections projecting from four peripheral sides of the center portion. In FIG. 1, the shape is such that two rectangles with a length L and width W (L>W) overlap each other with centers of gravity matching with each other and having directions along the length L being shifted from each other. The two rectangles are shifted by 90 degrees. The center portion is a square with sides W. Four rectangles or projections with a length L1 (=(L−W)/2) and a width W, which are project from four peripheral sides of the center portion. As shown in FIG. 1, the outer shape of the antenna 1 is substantially a cross shape. The cross shape is formed when the antenna is completed. Therefore, the antenna differs from the one which is formed temporarily during manufacture and is deformed into another shape finally as shown in FIG. 1 of Patent Document 2.

A conductive wire 2 is provided in such a way as to loop around the cross shape. In FIG. 1, a first loop path is formed which extends clockwise from a starting point A1, passing through points B1, C1, D1, E1, F1, G1, H1, J1, K1, and M1, to a point A2 close to the point A1. The loop path includes a part where two line segments with a length L1 define the right angle. For example, such a part is a zone C1-D1-E1, F1-G1-H1, or the like. This part allows the antenna 1 to execute transmission/reception of electric waves in all directions, and to have a circular polarization characteristic.

In the example of FIG. 1, the point A2 is positioned inward of the cross shape than the starting point A1. A second loop path is formed inward of the first loop path with the point A2 being a starting point. Likewise, third and fourth loop paths are formed in spiral in order. Providing a plurality of loop paths in spiral can ensure a long antenna length in a small area. As shown in FIG. 1, the spiral loops continue to near the center point in such a way that a blank portion where the conductive wire is not present cannot be formed substantially in the center portion.

In the example of FIG. 1, the width W is 19 mm, the extension length L1 is 27 mm, the width of a conductive wire 2 is 1 mm, and the gap between the conductive wires is 1 mm. Five loop paths are formed. Communication at a frequency of 950 MHz is assumed. The antenna is formed on a ferroelectric substrate such as a glass epoxy plate. Herein, a substrate is a glass epoxy plate with a relative dielectric constant of 4.8 and a dielectric tangent tan δ=0.018, and the conductive wire 2 is formed of copper with a thickness of 0.035 mm (dielectric constant=$5.8\times10^7$).

As described above, the conductive wire 2 is provided on the top surface of a relatively thin substrate, thus providing a planar antenna as a whole. Note that the planar antenna should not necessarily be a plane having no undulations. The antenna may be substantially of a plane which has a smaller degree of undulations for the width. While this antenna may be mounted on the top surface of an IC tag, a cellular phone terminal and the like, it is a planar antenna even in case of those products having a gentle curved surface unless the operational effects of the invention to be described later are deteriorated.

Some examples with changes in the outside dimension, wire width, etc. were also examined. While all the examples showed improvements on reduction in null angle and the circular polarization characteristic, the example shown in FIG. 1 was especially excellent at 950 MHz.

Figure 2:
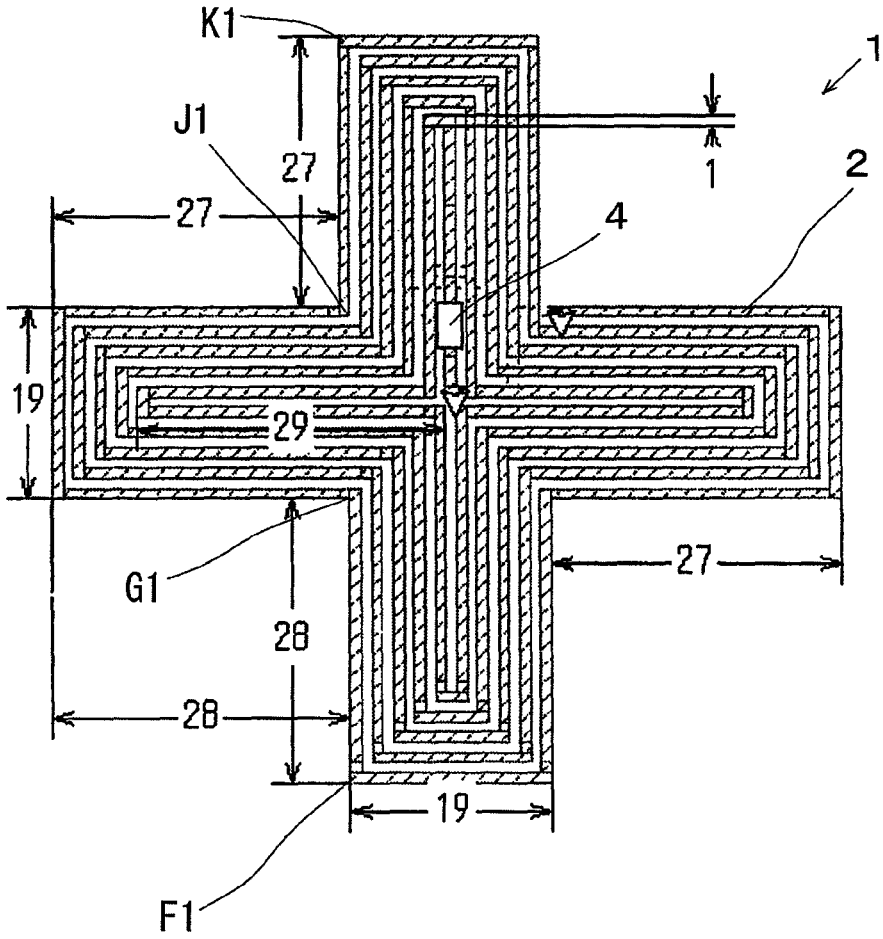
FIG. 2 is a plan view showing a second example of an antenna.
Figure 3:
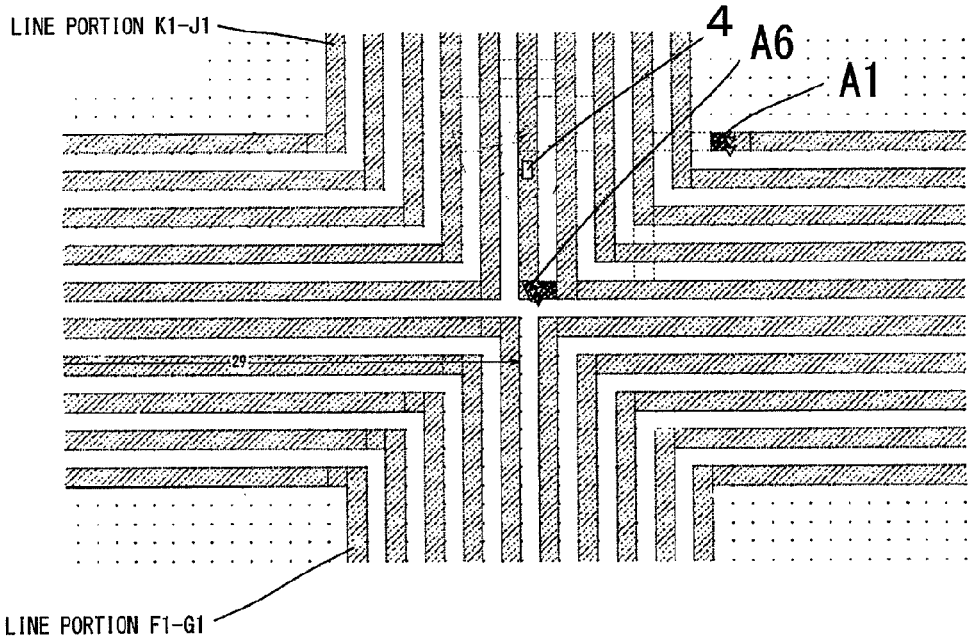
FIG. 3 is an enlarged plan view of the center portion of the second example of the antenna.
Figure 4:
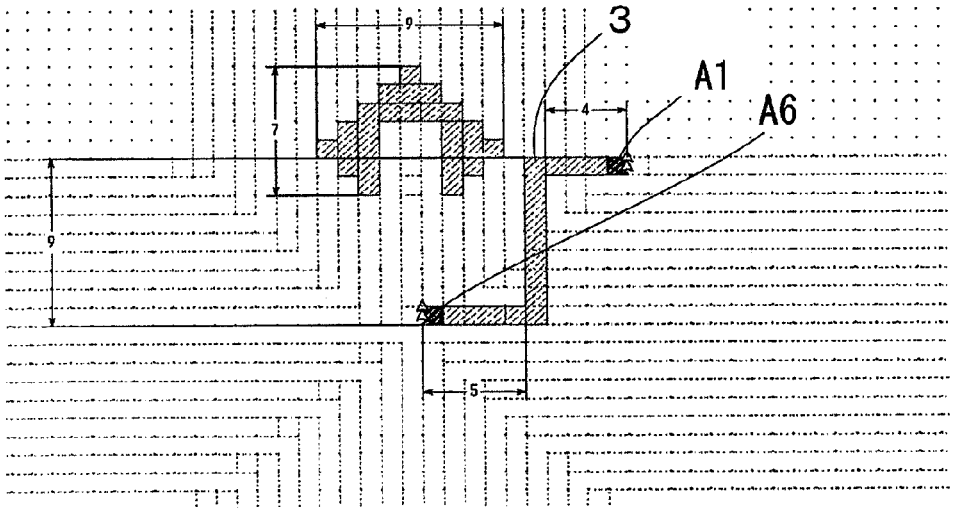
FIG. 4 is an enlarged bottom view of the central portion.

Next, a second example of the antenna will be described. FIG. 2 is a plan view showing the second example of the antenna, FIG. 3 is an enlarged plan view of the center portion of the second example, and FIG. 4 is an enlarged bottom view of the central portion. Communication at a frequency of 950 MHz is also assumed. The outer shape is substantially a cross shape with a width W of 19 mm and an extension length of 27 mm, and is substantially the same shape as that of the first example. However, the upper projection and the lower projection are shifted sideways by the width of the conductive wire 2. The positional relationship between the line segments F1-G1 and J1-K1 which form the first loop path, as seen from FIG. 3, is such that the line segment F1-G1 is not on the extension line of the opposing line segment J1-K1, but is at the position shifted in parallel from the extension line by the width of the conductive wire 2. Such a shape is also feasible.

Through holes are formed at the starting point A1 and an end point A6, and are connected to the back side of the substrate. A conductive wire 3 which connects the starting point A1 and the end point A6 is provided at the back side of the substrate, forming a loop antenna.

Figure 5:
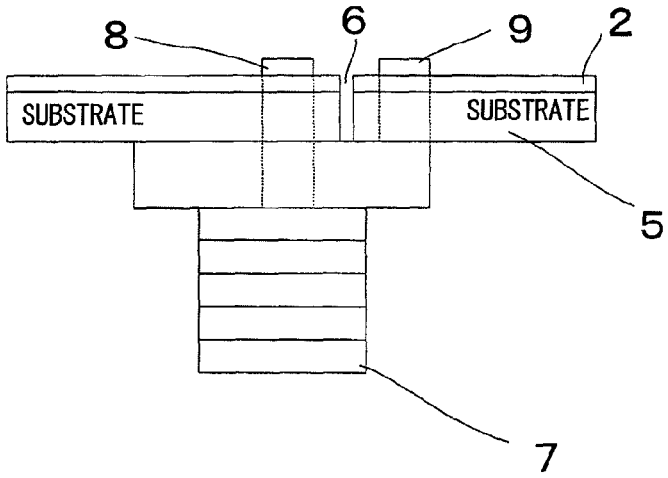
FIG. 5 is a cross-sectional view exemplarily showing a power feeding point.

FIG. 5 is a cross-sectional view exemplarily showing a power feeding point. A gap 6 of 0.120 mm is provided at the conductor 2 and the substrate 5. One end side of the conductor 2 which is separated by this gap 6 is connected to a central conductor 8 of a coaxial connector 7, and the other end side is connected to a ground conductor 9 of the coaxial connector 7. Electric power is supplied from the transmission/reception circuit by connecting a coaxial cable to the coaxial connector 7.

Providing a power feeding point 4 in the central square of the cross shape makes it easier to obtain impedance matching. It is preferable to shift the power feeding point 4 slightly outward of the exact center.

Figure 6:
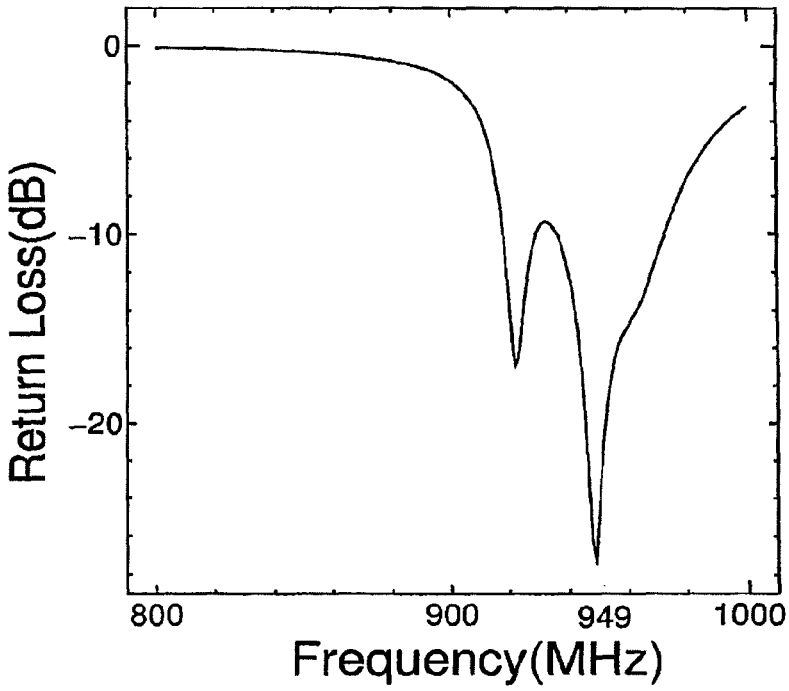
FIG. 6 is a graph illustrating the return loss characteristic of the antenna of the first example through simulation.
Figure 7:
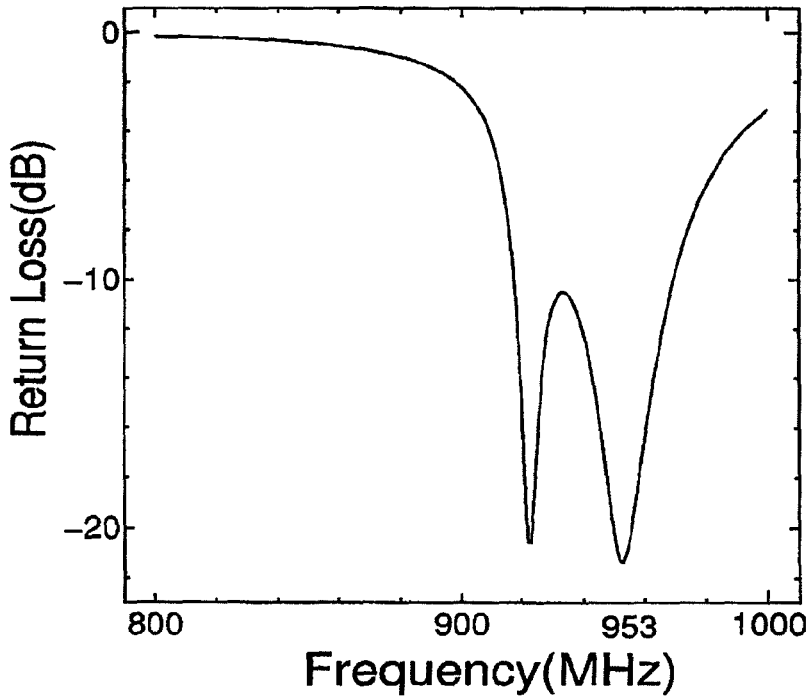
FIG. 7 is a graph illustrating the return loss characteristic of the antenna of the second example through simulation.

The characteristic of the antenna obtained through simulation will be described. FIG. 6 and FIG. 7 are graphs respectively illustrating the return loss characteristics of the first example and the second example. Both graphs show similar characteristics. Matching is obtained at about 950 MHz. Return loss is seen in a wide range.

Figure 8:
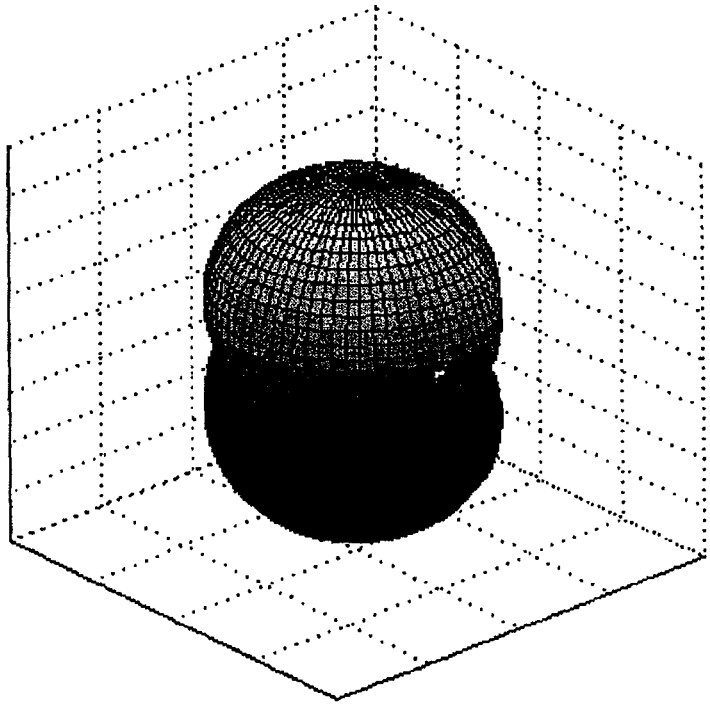
FIG. 8 is a graph illustrating the three-dimensional directivity of the antenna of the first example through simulation.
Figure 9:
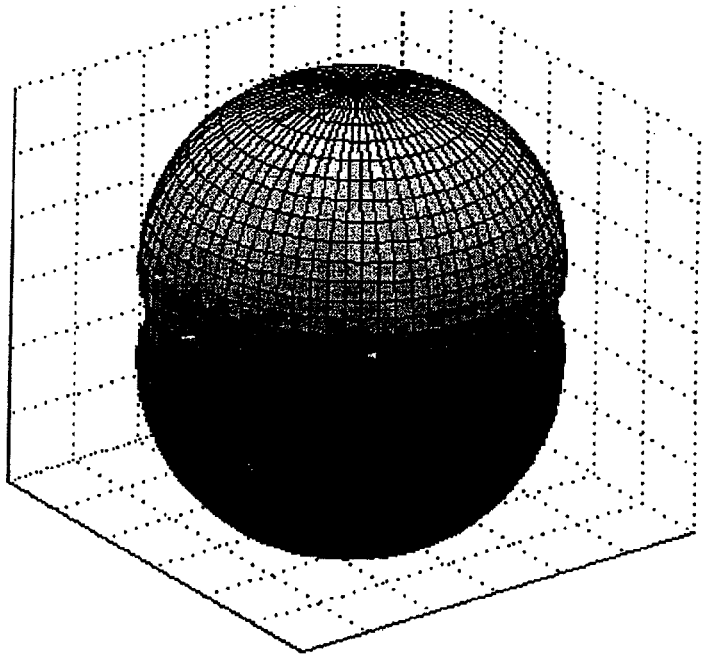
FIG. 9 is a graph illustrating the three-dimensional directivity of the antenna of the second example through simulation.
Figure 10:
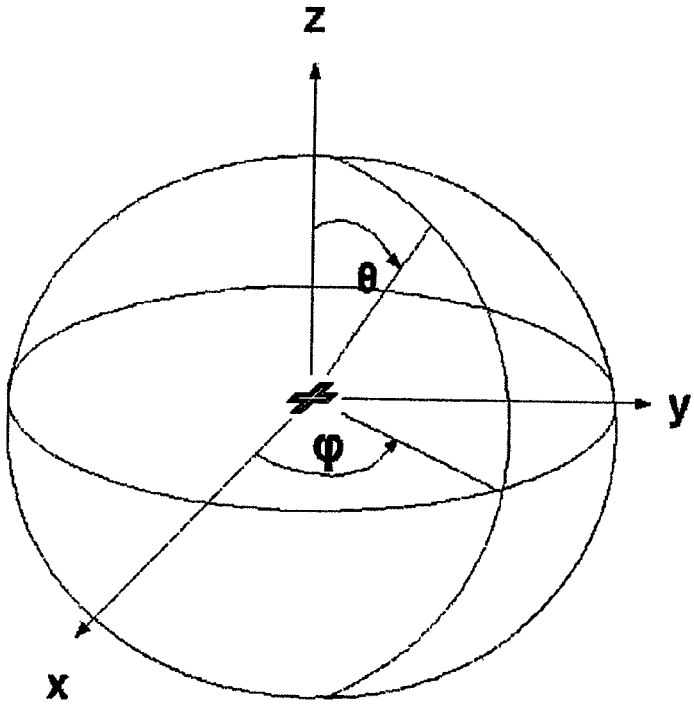
FIG. 10 is a perspective view showing coordinates.

FIG. 8 and FIG. 9 are graphs respectively illustrating the three-dimensional directivities of the first example and the second example through simulation. FIG. 10 is a perspective view showing coordinates. Both of the first example and the second example show omnidirectivities hardly having a null point.

Figure 11:
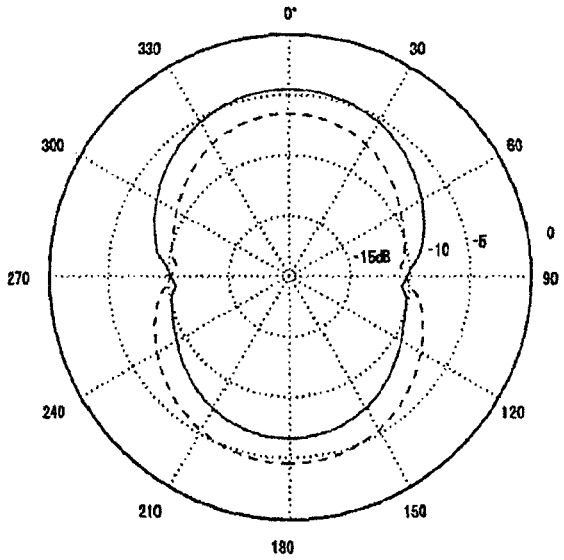
FIG. 11 is a graph illustrating the polarization characteristic of the antenna of the first example through simulation.
Figure 12:
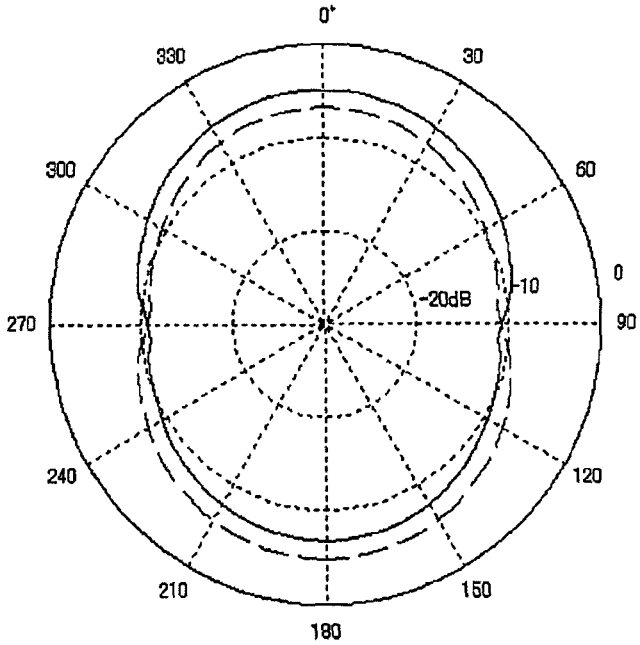
FIG. 12 is a graph illustrating the polarization characteristic of the antenna of the second example through simulation.

FIG. 11 and FIG. 12 are graphs respectively illustrating the polarization characteristics of the antenna of the first example and the second example through simulation. FIG. 11 and FIG. 12 show the field intensities of the main polarization and cross polarization seen in terms of a θ angle at $\phi=45°$ in the coordinates in FIG. 10; solid lines show the main polarization, and dashed lines show the cross polarization. Both show excellent circular polarizations with low dependency on the plane of polarization.

Figure 16:
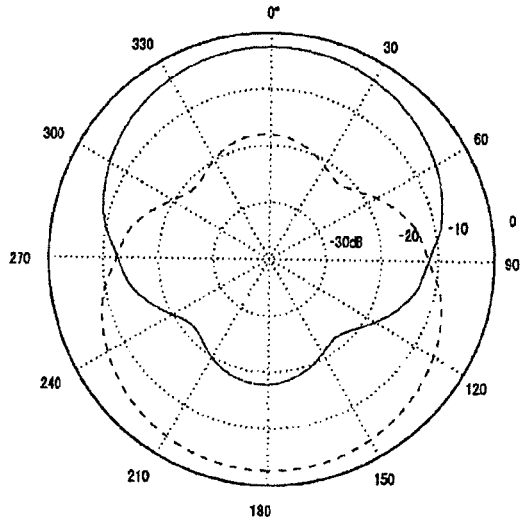
FIG. 16 is a graph illustrating the field intensity of the circular polarization of the antenna of the first example through simulation.
Figure 17:
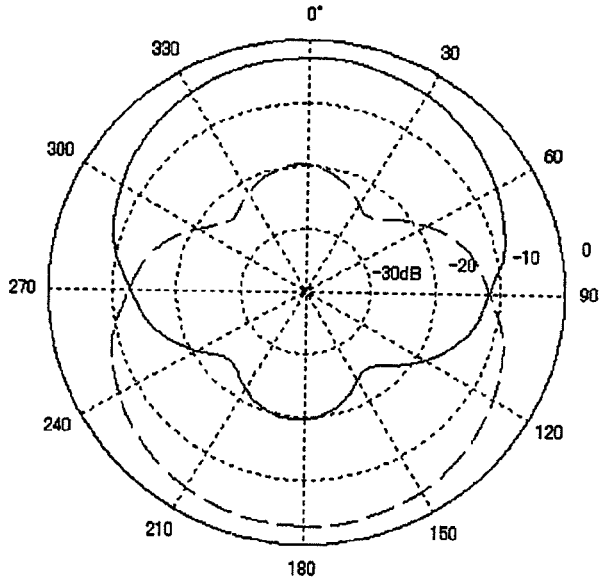
FIG. 17 is a graph illustrating the field intensity of the circular polarization of the antenna of the second example through simulation.
Figure 18:
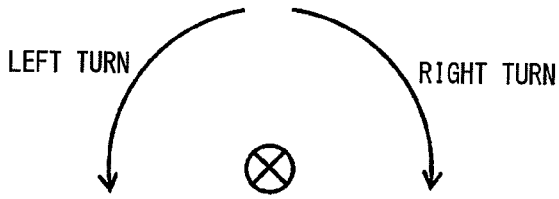
FIG. 18 is an explanatory diagram of the turning direction of circular polarization.

FIG. 16 and FIG. 17 are graphs respectively illustrating the field intensities of the circular polarizations of the antennas of the first example and the second example through simulation. FIG. 18 is an explanatory diagram of the turning direction of circular polarization. In FIG. 18, the electric wave is traveling from the near side of the sheet toward the other side. As shown in FIG. 18, the case where the turning direction of the electric field is clockwise is defined as right turn, and the case of the counterclockwise is defined as left turn. In either one of the antennas of the first example and the second example, the right-turn field intensity is significantly larger than the left-turn field intensity. When these antennas are used for transmission, therefore, they transmit right-turn electric waves well, but hardly generate left-turn electric waves.

The directions of the loops of the conductive wires in these antennas will be described based on FIG. 1 and FIG. 3. Tracing the line path from the power feeding point A1 near the center portion as the starting point to the end point A6 at the outermost loop show the formation of a swirl looping counterclockwise. In case of such a loop direction of the conductive wire, as shown in FIGS. 16 and 17, the characteristic is such that only a right-turn electric wave is transmitted. When the antennas are used for reception, however, the characteristic is the opposite, so that in case of the loop direction of the conductive wire as shown in FIG. 1, only a left-turn electric wave is transmitted, and a right-turn electric wave is hardly received.

Next, the characteristics of the antenna which are obtained through actual measurement will be described. The antenna of a second embodiment was made and the characteristics thereof were examined.

Figure 13:
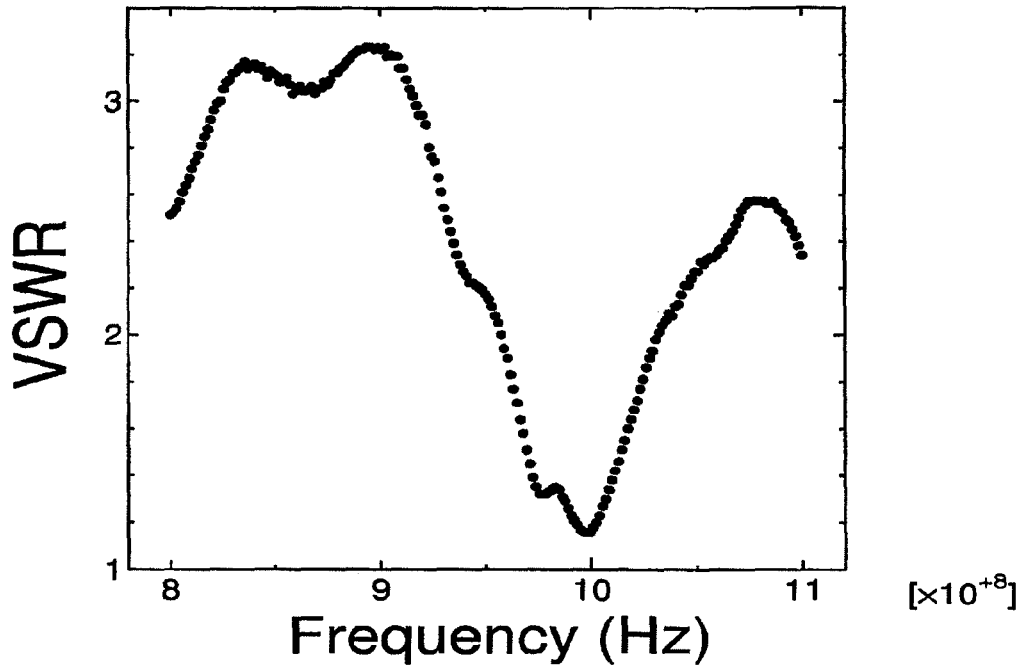
FIG. 13 is a graph illustrating the return loss characteristic based on the actual measurement.

FIG. 13 is a graph illustrating the return loss characteristic based on the actual measurement. While the characteristic is shown in terms of the VSWR characteristic different from the one in FIG. 7 in unit, it turns out that the simulation and the actual measurement substantially correspond to each other.

Figure 14:
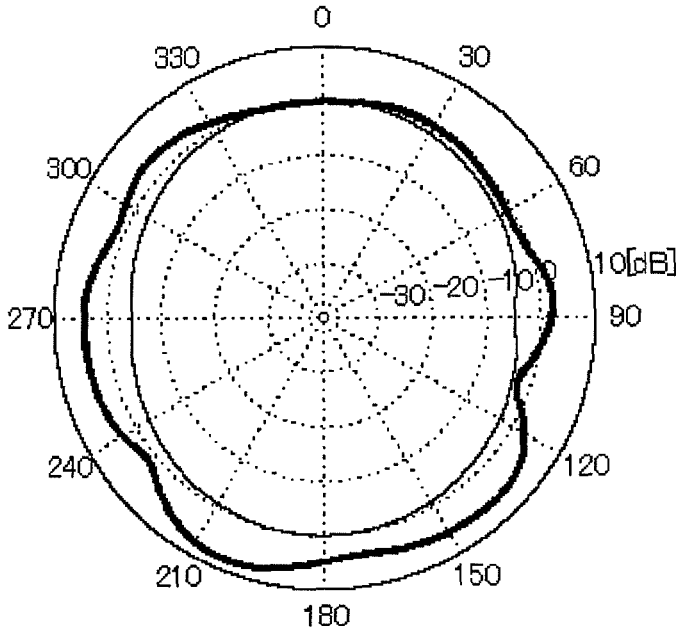
FIG. 14 is a graph illustrating the directivity based on the actual measurement.

FIG. 14 is a graph illustrating the directivity based on the actual measurement. The H plane radiation directivity is shown as 0 dB at $\theta=0°$. It is shown that a null point hardly exists.

Figure 15:
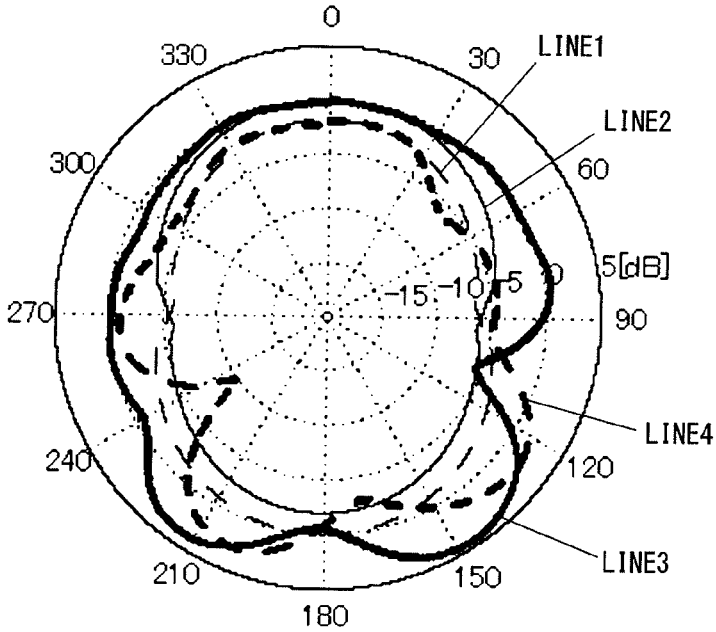
FIG. 15 is a graph illustrating the polarization characteristic based on the actual measurement.

FIG. 15 is a graph illustrating the polarization characteristic based on the actual measurement. The main polarization v.s. cross polarization characteristic is shown as 0 dB at $\theta=0°$. Simulated values are also shown together with the actual values. A thin solid line (line 1) shows the simulated values of the main polarization, a thin dashed line (line 2) shows the simulated values of the cross polarization, a thick solid line (line 3) shows the actual values of the main polarization, and a thick dashed line (line 4) shows the actual values of the cross polarization. Although the actual values show a slight difference which originates from the measuring environment, the actual values approximately correspond to the simulated values, and a good circular polarization characteristic can be observed.

As apparent from the above, although the antenna according to the invention has a simple structure, it hardly has a null angle, and can communicate in all directions. The technology established in the formation of wiring patterns, such as etching to a glass epoxy substrate, can be used as it is. In addition, the transmission/reception circuit should not necessarily be complex, and even a transmission/reception circuit used in IC tags, IC readers/writers or the like in the past can execute communication using circular polarization.

In the foregoing example (FIG. 2), the conductive wire 3 connecting the starting point A1 and the end point A6 at the back side of the substrate was attached as a jumper line, and the entire conductive wire become a loop antenna. However, it is possible to form a loop antenna part forming a closed curve line, and a bar antenna part having one end electrically open without providing the conductive wire 3. In the example in FIG. 1, a loop is formed starting from a point X0 at the center portion and looping counterclockwise in the order of X0-X1-X2-X3-X4. Two points X0 and X1 close to each other are power feeding points. Therefore, the conductive wire of X0-X1-X2-X3-X4 forms the loop antenna part. While on the other hand, the conductive wire extended upward from the point X4 to the final point A6 at the outermost circumference is a bar antenna part. Because the jumper line is not provided, points starting at and following the point X4 do not have electric connection to form a loop, and the end point A6 is open. As the antenna is formed by the combination of the loop antenna part and the bar antenna part as mentioned above, the range of the frequency where transmission and reception are feasible can be made wider.

First Embodiment

A first embodiment of the invention will be described. The antenna according to the invention can be used in an IC tag or an IC reader/writer, or both. When the antenna is used in an IC reader/writer, the antenna as shown in, for example in FIG. 1 or FIG. 2 can be used. In case of the IC reader/writer, the antenna need not be made so small, but higher performance is rather important. In case of the antenna shown in FIG. 1 or FIG. 2, communication is executed at 950 MHz as the frequency. The conventional transmission/reception circuit may be sufficient, and with the antenna according to the invention being provided, the invention can be adapted by hardly changing the body part of the IC reader/writer by forming the antenna of the invention. As the IC reader/writer side is provided with the omnidirectivity and circular polarization characteristic, the antenna on the IC tag side, even if having the directivity and linear polarization characteristic, can execute proper communication.

Since the antenna according to the invention can easily be miniaturized by reducing the width of the conductive wire to increase the loop density, the antenna can also be adapted to the antenna of the IC tag. As the antenna of the IC tag is provided with the omnidirectivity and circular polarization characteristic, proper communication can be executed even if the IC reader/writer is the conventional type. Moreover, the communication performance is improved further by using the antenna in both the IC tag and the IC reader/writer. As illustrated in this embodiment, the application of the invention to an IC tag or an IC reader/writer can ensure adequate transmission and reception regardless of from which direction the IC tag approaches the IC reader/writer, or regardless of which direction the IC tag faces.

Second Embodiment

The second example of the invention will be described. The antenna according to the invention can be used in a global positioning system (GPS). When the antenna is used in a car navigation device or the like, the antenna according to the invention is mounted on the roof or dashboard of a car.

Here, the loop direction of the conductive wire of the antenna is selected according to the turning direction of the circular polarization electric wave to be received. In case of receiving a left-turn electric wave, for example, the turning direction of the conductive wire as shown in FIG. 1 is selected. That is, the antenna is installed in the direction as shown in FIG. 1 as seen from above. As shown in FIG. 16 or FIG. 17, the left-turn electric wave is received with a good sensitivity. When a direct wave is a left-turn wave, it can be received well. On the other hand, a multipath wave reflected at the walls of a building, or the like turns rightward, and is thus hardly received. Therefore, the antenna is not easily adversely affected by the multipath wave. In case of receiving the right-turn circular polarization, the antenna having the conductive wire looped in the opposite direction to the direction shown in FIG. 1 or FIG. 2 is used.

The electric waves used for GPS in Japan are usually right-turn. A direction opposite to the turning direction of the conductive wire as shown in FIG. 1 is selected. That is, the antenna is installed in the direction shown in FIG. 1 as seen from the back side (below). In this case, only the right-turn direct wave transmitted from a GPS satellite is received, and the left-turn multipath wave is hardly received.

Third Embodiment

A third embodiment of the invention will be described. The antenna according to the invention can be used in a ground digital television set built into a mobile terminal, such as a cellular phone. Because the antenna according to the invention is a planar antenna, and can easily be miniaturized, it can be installed in the body part of a cellular phone or the like. Although the conventional cellular phone which is compatible with the ground digital television set needs a dipole antenna projecting from the body part, the application of the invention eliminates the need for such a projection.

Since the electric wave of the ground digital television broadcasting is a linearly polarized wave, the conventional dipole antenna drops the reception when the direction of the antenna does not match with the direction of polarization. However, the antenna according to the invention has high receiving ability for the cross polarization as well as for the main polarization as shown in FIG. 11, FIG. 12, and FIG. 14. Therefore, television broadcasting can be received well irrespective of the direction of the receiving terminal (i.e., direction of the antenna).

The invention claimed is:

1. An antenna including a conductive wire arranged in loops that form a cross shape and which has a quadrangular center portion and four projections projecting from four peripheral sides of the quadrangular center portion, wherein the antenna includes a loop antenna part forming a closed curve, and a bar antenna part having a plurality of spiral loops forming the cross shape and having one end electrically open, and a power feeding point provided at the loop antenna part in a central square of the cross shape.

2. The antenna according to claim 1, wherein the power feeding point is a gap which separates the conductive wire, and one end side of the conductive wire which is separated by the gap is connect to a central conductor of a coaxial connector and the other end side is connected to a ground conductor of the coaxial connector.

* * * * *